US010167171B2

(12) United States Patent
Ladner et al.

(10) Patent No.: US 10,167,171 B2
(45) Date of Patent: Jan. 1, 2019

(54) ELEVATOR WITH BRAKE DEVICE IN THE MANNER OF A CLAMP BRAKE

(71) Applicant: Wittur Holding GmbH, Wiedenzhausen (DE)

(72) Inventors: Peter Ladner, Hellmonsodt (AT); René Holzer, Scheibbs (AT); Karl Kriener, Viehdorf (AT); Bernd Winkler, St. Florian (AT); Erich Berghammer, Linz (AT)

(73) Assignee: Wittur Holding GmbH, Wiedenzhausen (DE)

( * ) Notice: Subject to any disclaimer, the term of this patent is extended or adjusted under 35 U.S.C. 154(b) by 240 days.

(21) Appl. No.: 15/227,952

(22) Filed: Aug. 3, 2016

(65) Prior Publication Data

US 2017/0036888 A1 Feb. 9, 2017

(30) Foreign Application Priority Data

Aug. 5, 2015 (DE) ..... 20 2015 104 095 U

(51) Int. Cl.
*B66B 1/36* (2006.01)
*B66B 5/18* (2006.01)

(52) U.S. Cl.
CPC ..... *B66B 1/365* (2013.01); *B66B 5/18* (2013.01)

(58) Field of Classification Search
CPC ..... B66B 1/365; B66B 5/18
See application file for complete search history.

(56) References Cited

U.S. PATENT DOCUMENTS

| | | | | |
|---|---|---|---|---|
| 405,371 | A | 6/1889 | Nickerson | |
| 930,412 | A | 8/1909 | Nunnink et al. | |
| 5,803,211 | A * | 9/1998 | Wilke | B60T 13/743 188/173 |
| 9,511,977 | B2 * | 12/2016 | Schautt | B66B 5/24 |
| 2016/0355377 | A1 * | 12/2016 | Husmann | B66B 5/18 |

FOREIGN PATENT DOCUMENTS

| | | | |
|---|---|---|---|
| DE | 102011000720 | A1 | 8/2012 |
| EP | 1067084 | A1 | 1/2001 |
| EP | 1657204 | A2 | 5/2006 |
| JP | 2009046246 | A | 3/2009 |
| WO | 2014154306 | A1 | 10/2014 |

* cited by examiner

*Primary Examiner* — Diem M Tran

(57) ABSTRACT

An elevator with a brake device for braking a car and/or keeping it stationary on at least one braking rail. The brake device has at least two brake shoes situated opposite from each other, and at least one brake clamp with two clamp arms for opening and closing clamp jaws acting on the brake shoes. In certain embodiments, only one of the clamp arms is connected to the car in pivoting fashion via a bearing with a pivot axle that is affixed to the car, oriented parallel to the direction of travel. In certain embodiments, the brake clamp is supported on the car in such a way that the clamp jaws, by pivoting together in the same direction, are able to follow a movement that is forced on a brake shoe due to local position deviations of the associated braking rail.

15 Claims, 5 Drawing Sheets

ELEVATOR WITH BRAKE DEVICE IN THE MANNER OF A CLAMP BRAKE

FIELD OF THE INVENTION

The invention relates to an elevator with a brake device.

BACKGROUND OF THE INVENTION

Brake devices for elevators that bring the car to a stop in emergency situations or that hold it at the height of a stop, for example, during regular operation so that no unwanted movement of the car takes place are known in the prior art. Recently, such brake devices are in many cases no longer actuated in a purely mechanical fashion by an overspeed governor rope that exerts a locking action, but rather by means of actuators that are electrically, pneumatically, or hydraulically actuated. Such actuators cannot be embodied as arbitrarily powerful, particularly not if they must also be kept ready for operation even in the event of a power failure by means of an emergency power supply that travels along with the car. It is therefore already known to have such actuators not act directly on the brake linings, for example like a brake piston that is known from passenger vehicles, but rather to act on it via a lever transmission that intensifies the force exerted by the actuators.

One example of this is European patent application EP 1 067 084 A1. The patent application proposes an actuator, which is embodied in the form of a solenoid, hydraulic cylinder, or lifting spindle motor and via a tie rod, acts on a toggle lever mechanism that increases the actuation forces by several times and in this way, the brake shoes are acted on with corresponding normal forces.

In this design, a critical feature is that the toggle lever mechanism has pivot points that are supported in stationary fashion relative to the car. In this way, the position of the toggle lever mechanism is necessarily predetermined by the position that the car currently assumes relative to the guide rail at the point at which the toggle lever mechanism is to press the brake linings against the guide rail. This means that an automatic centering of the toggle lever mechanism relative to the guide rail used for the braking is not possible. Instead, the toggle lever mechanism is only centered on the guide rail if the entire car is held in its car guides on the guide rails so that the guide rail used for the braking has a precisely centered position at the height of the toggle lever mechanism.

The object of the invention is to remedy this problem.

SUMMARY OF THE INVENTION

The solution according to the invention is first carried out with the features described as follows.

An elevator is provided with a brake device for braking a car and/or keeping it stationary on at least one braking rail. From a patent law standpoint, a guide rail generally functions as a so-called braking rail.

The brake device has at least two brake shoes situated opposite from each other, which can be pressed against the braking rail to execute a braking or holding action. The brake device also has at least one brake clamp with two clamp arms for opening and closing the clamp jaws, which act on the brake shoes, generally so that they exert a normal force on the brake shoes.

According to the invention, only one of the clamp arms of the at least one brake clamp is connected to the car in pivoting fashion via a bearing with a pivot axle that is affixed to the car, oriented parallel to the direction of travel. This means that at the point at which this clamp arm is connected to the bearing, it cannot execute any movement with a translatory component relative to the car. By contrast, the other clamp arm of this brake clamp is generally not affixed at any point relative to the car, i.e. along its entire length, it is able to execute a movement relative to the car, even a movement with a translatory component. This special type of bearing support permits the brake clamp to automatically center itself relative to the section of the braking rail that is currently situated in a position in which it is ready to interact with the brake shoes. The automatic centering can be carried out in that the entire brake clamp as a unit pivots about the pivot axle that is affixed to the car, parallel to the direction of travel; in this case, the brake clamp can also inherently pivot in the sense that its individual components move relative to one another, even if most often, they only do so by small amounts. In this way, at the latest, the brake clamp automatically centers itself when the brake is applied.

In the context of a preferred embodiment, the other clamp arm 7*b* that is not connected to a pivot axle connected in stationary fashion relative to the car is connected to and interacts with an actuator for actuating the brake clamp. In this way, the actuator can act directly on one of the clamp arms without the actuator itself having to be mobile in any way. Instead, the actuator can be fixed relative to the car, with only one actuating rod or actuating piston being mobile relative to the car. This eliminates the need for complex cabling or piping for the actuator of the kind that would be required if the actuator also had to be moved together with the brake clamp that is supported so that it can be moved as a unit.

In a particularly preferable embodiment, at least one spring element, which is able to close the brake clamp completely, acts on the brake clamp in such a way that the brake clamp places the brake shoes against the braking rail so that the brake produces its nominal braking force, i.e. the maximum braking force that it should be able to achieve when functioning properly. In this way, the brake device is "fail-safe" and can catch the car and bring it to a complete stop even if for some reason, a total failure of the power supply for the actuator has occurred.

Preferably, the at least one spring element is situated in a region of the clamp arms that lies between the actuator and a coupling element, which connects the two levers that constitute the clamp arms to each other. This then results in the fact that the actuator acts on a larger lever arm than the spring element. In this way, even an actuator of relatively small dimensions can overcome the forces of the spring element and the brake in the released state.

As one solution alternative for the problem mentioned at the beginning, the invention proposes a generic elevator in which the brake clamp is supported on the car—or on a component affixed to the car—in such a way that the clamp jaws, by pivoting together in the same direction as the lever arms of the brake clamp, are able to follow a movement, that is forced on the brake shoes due to local position deviations of the associated braking rail. Such a design is once again self-centering.

Such a self-centering is even possible if a brake shoe briefly comes into contact unintentionally with the guide rail while the brake is still released due to a local position deviation of the guide rail. Specifically, if the guide rail pushes a brake shoe outward in the event that such a contact occurs between the two, then as a result, the entire brake clamp pivots into a new position. It is thus possible to rule out the eventuality of a considerable frictional contact unintentionally occurring between the brake shoes and the guide rail.

An alternative solution that is claimed as automatically protected in the context of this invention is based on the problem of creating a brake clamp that is as delicate as possible, by means of which it is nevertheless possible to exert significant normal forces on the brake shoes.

This object is in turn attained by an elevator with a brake device for braking a car and/or holding it immobilized on at least one braking rail. Here, too, a guide rail is generally used as the braking rail. Once again, the brake device includes at least two brake shoes that are positioned opposite each other and are intended to act on the braking rail. In addition, this brake device has a brake caliper on which the brake shoes are movably supported. The brake caliper and the support of the brake shoes in it are embodied so that during braking, the brake caliper transmits the braking forces produced by the brake shoes directly to the car. In addition, the brake device, as before, has a brake clamp that is preferably embodied as explained above, with two clamp arms for opening and closing the clamp jaws that act on the brake shoes. According to the invention, the brake clamp and the brake caliper are embodied so that from the brake clamp to the brake shoes and from the brake shoes to the brake clamp, no forces are transmitted that act parallel to the direction of travel, i.e. no transmission of shear forces takes place.

For all embodiments, it is particularly advantageous if the brake clamp is a four-bar linkage composed of two lever arms and one coupling element preferably embodied in the form of a rod, in which the two lever arms are attached in pivoting fashion to different points on the coupling element. In this way, not only can the entire brake clamp be pivoted about the pivot axle that is affixed to the car at one of its clamp arms, but also the brake clamp is in itself pivotable, i.e. a clamp jaw, which has already been pressed against the guide rail by the brake shoe, is able to pull the other clamp jaw, which has not yet come into contact, toward it and to then place it likewise against the guide rail by means of the brake shoe.

It is particularly advantageous if each of the clamp jaws is coupled to the brake shoe(s) allocated to it in such a way that only normal forces can be transmitted between the clamp jaws and the brake shoe(s). Ideally, at least small rolling movements between the respective clamp jaw and the brake shoe(s) allocated to it are possible. This promotes the self-centering of the brake clamp.

Other advantages, functionalities, and embodiment options are revealed by the exemplary embodiment explained on the basis of the figures.

DETAILED DESCRIPTION OF THE INVENTION

In schematic diagrams, FIGS. 1 through 4 show the basic functionality and basic design of the brake device 1 according to the invention.

The Brake Clamp

The brake device 1 is composed of a first lever arm 5*a* that constitutes the brake clamp and a second lever arm 5*b* that constitutes the brake clamp. The lever arms are connected to each other by means of a coupling element 6. In this case, each of the lever arms 5*a*, 5*b* is preferably attached in pivoting fashion to different points on the coupling element.

Figure 1:
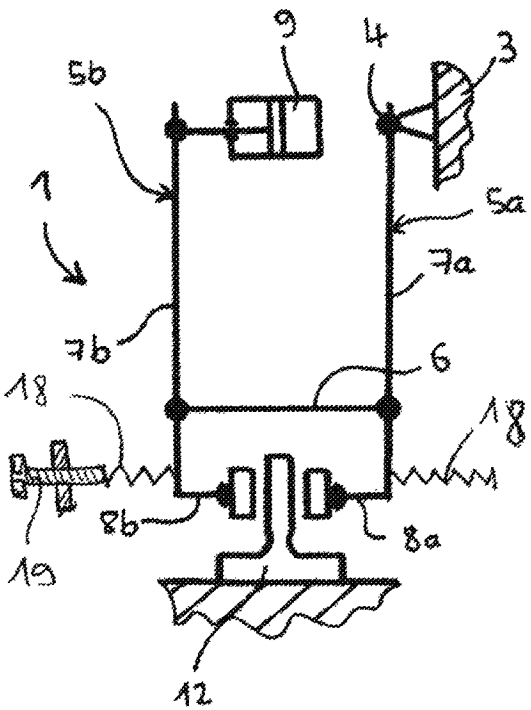
FIG. 1 schematically depicts the embodiment of the brake clamp according to the invention in the normal position, i.e. when the guide rail is positioned in a centered fashion relative to the brake shoes.

As is clearly shown in FIG. 1, the coupling element 6 divides each of the two lever arms 5*a*, 5*b* into two sections. Thus on each of the two lever arms, a respective clamp arm 7*a* or 7*b* is produced on the side of the coupling element 6 oriented away from the brake shoes 11 and a respective clamp jaw 8*a* or 8*b* is produced on the side of the coupling element 6 oriented toward the brake shoes 11.

Preferably, the coupling element is positioned directly adjacent to the brake caliper. This achieves a large power increase. In the specific exemplary embodiment here, the first main spring 14*a* oriented toward the brake shoes, which constitutes a part of the main spring element 10, acts on a lever arm with the ratio 1:1 relative to the brake shoes, whereas the second main spring 14*b* oriented away from the brake shoes acts relative to the brake shoes on a lever arm with the ratio 1:2 relative to the brake shoes. This produces a resulting power-increase ratio for the main spring element of 1:1.5. In general, it can be stated that the main spring element as a whole should have a power-increase ratio relative to the brake shoes of from 1:1.2 to 1:1.8. By contrast, the actuator 9 should act on the brake shoes based on a lever arm, which produces a power-increase ratio of at least 1:2.5 or better still at least 1:3. The resulting total force that is exerted by the main spring element on a brake clamp results in a normal force on the brake shoes that is greater by at least a factor of 1.2 or better still, a factor of 1.5.

According to the invention, a bearing pedestal 3 is provided, which is affixed to the car in stationary fashion and which defines a pivot axle 4, which will be defined in greater detail below and via which the first lever arm 5*a* is connected to the car in pivoting fashion. In this way, the brake clamp forms a four-bar linkage, whose one lever arm 5*b* and whose coupling element 6 not only are able to execute a rotary movement, but also have the ability of executing as a unit a movement with a translatory component. The lever arm 5*a* does not have this ability; it can as a unit only execute a rotary movement about the pivot axle 4.

It should also be noted in conjunction with FIG. 1 that the brake clamp can optionally be provided with a centering device that assists in establishing the home position that the completely released inactive brake clamp assumes.

Figure 2:
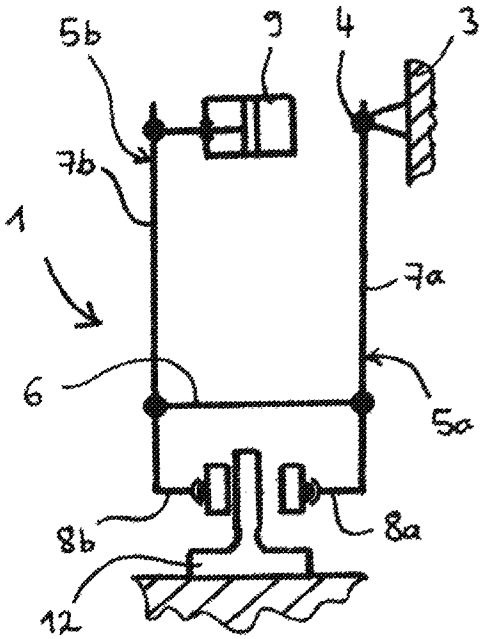
FIG. 2 schematically depicts the situation when the guide rail in the region of the brake device has a local position deviation relative to the car and the brake is still in the released state.

Preferably, the centering device is composed of at least one centering spring element 18 that acts perpendicular to the longitudinal axis of the rail and that can be moved back and forth perpendicular to the longitudinal axis of the rail e.g. with the aid of a centering screw 19 in order to push or pull the brake clamp into the desired position. Where only compression springs are used as the centering spring element, at least one other centering spring element 18 must be provided, as shown in FIG. 2.

The Actuator and the Main Spring Element

An actuator 9 acts on the second lever arm 5*b* that constitutes a brake clamp, preferably on its end or a section that is close to the end and constitutes less than 20% of the length of the clamp arm 7.

Ideally, the actuator is arranged so that the pivot axle 4 lies in the working plane of the actuator, i.e. in the plane in which it exerts forces and transmits them to the clamp arm 7*b* allocated to it. This ensures that the brake clamp does not experience any torque during braking and therefore is not pivoted about the pivot axle 4 in an unwanted way by the forces exerted by the actuator.

At the same time, at least one main spring element 10 acts on the brake clamp constantly in that the main spring element 10 is installed between the two clamp arms 7*a* and 7*b* and is fastened to them so that it has the tendency to push the two clamp arms 7*a* and 7*b* away from each other. The main spring element 10 is preferably a disc spring packet or a spiral spring, preferably with a rectangular or square cross-section, as is known from springs for presses.

The actuator 9 is preferably a hydraulic actuator or alternatively also a solenoid or linear motor. As long as the actuator 9 is acted on with pressure or electrical current, it pulls the clamp arm 7*b* and thus keeps the brake clamp open in opposition to the closing action of the spring element 10. If the actuator is switched into the unpressurized or currentless state or if the pressure acting on the actuator is at least reduced or the excitation of the solenoid is reduced, then the main spring element 10 pushes the two clamp arms 7*a* and 7*b* apart from each other. Their movement is deflected by the coupling element 6 so that the two clamp jaws 8*a* and 8*b* the brake shoes 11 rest against the opposing surfaces of the braking rail. The braking rail could be an independent component, but is usually one of the guide rails 12. The at least one main spring element 10 or the totality of the main spring elements 10 acting on a brake clamp is designed so that when the actuator 9 is completely deactivated, it presses the two brake shoes so powerfully against the braking rail that this brake clamp produces its nominal braking action.

It should also be noted that the actuator preferably has a piston rod or actuating rod via which it acts on the clamp arm 7*b* that is allocated to it. This actuating rod is generally connected to the clamp arm 7*b* in articulating fashion; in individual cases, however, it can also be sufficient if the actuating rod is not firmly affixed to the clamp arm 7*b*, but instead rests against it so that the actuating rod is able to transmit or exert a compressive force on the clamp arm 7*b*.

The interaction or connection between the clamp arm 7*b* and the actuating rod of the actuator 9 is preferably embodied so that the clamp arm 7*b* is not able to transmit any—or any significant—transverse forces on the actuator 9 lateral to its actuating direction. This is important in order to avoid damage to the actuator, for example when the actuator is embodied in the form of a piston cylinder apparatus for a hydraulic actuation.

The Brake Caliper and the Brake Shoes

Based on FIG. 1, it is clear that the two clamp jaws 8*a* and 8*b* preferably interact with the brake shoes 11*a*, 11*b* so that the two clamp jaws 8*a* and 8*b* are entirely or at least essentially only able to transmit normal forces to the brake shoes and vice versa.

Figure 4:
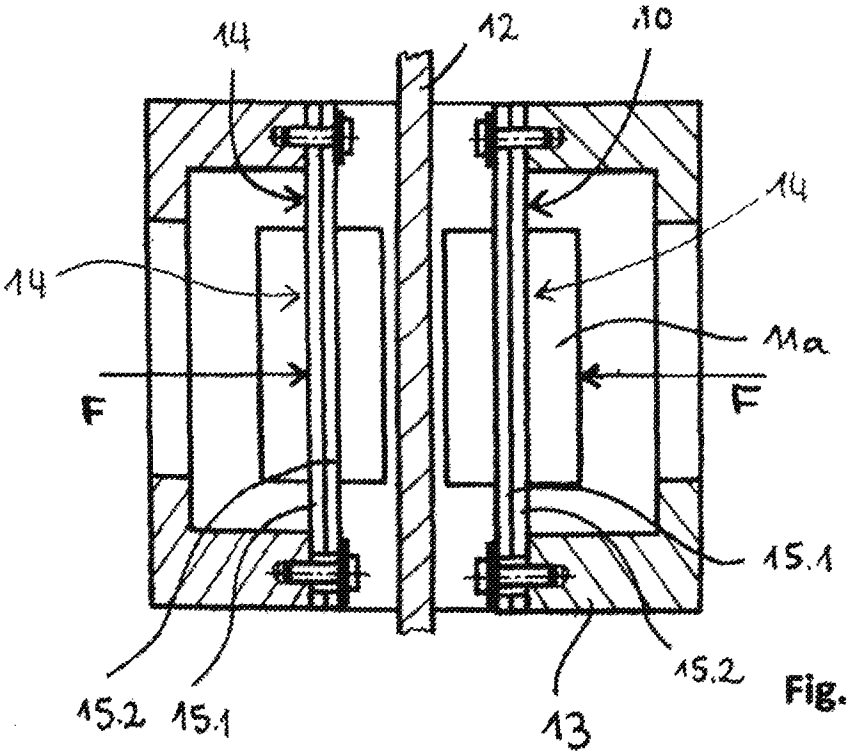
FIG. 4 schematically depicts the brake caliper and the brake shoes as well as the way in which the latter are held relative to the brake caliper and thus the structure for holding the brake shoes that is preferably used in the context of the invention.

This is possible because the brake shoes in turn are secured to a brake caliper that is usually embodied as a fixed caliper, i.e. one that is mounted as a unit rigidly relative to the car, as shown by the schematic depiction in FIG. 4.

The brake caliper 13 is clearly visible here. Each of the brake shoes 8*a*, 8*b* is secured to the brake caliper by means of a spring element 14. In general, the spring element 14 is embodied as a packet composed of a plurality of leaf spring leaves 15.1 through 15.2 (or 15.*n*, not shown) stacked onto one another perpendicular to the direction of travel, which can slide against one another locally when a load is placed onto them. The leaf spring leaves are preferably very thin; their thickness in the actuation direction of the brake shoes is generally less than 0.25 mm, ideally 0.1 mm±0.02 mm. They form a three-point support, i.e. the leaf spring leaves are each affixed to the brake caliper 13 in the region of their outermost ends and have another attachment in the vicinity of the middle of the brake lining, where they are affixed to it, generally by means of a screw that is inserted through them.

Most often, an embodiment is selected in which the leaf spring element extends through the brake shoe 11*a*, 11*b* that is allocated to it, even though this is not absolutely required. The spring element 14 is then fastened to the brake shoe 11*a*, 11*b* in the vicinity of the latter's middle, preferably being screwed to it. At two opposing ends, the spring element protrudes beyond the brake shoe 11*a*, 11*b* that is allocated to it and then at each protruding end, preferably forms at least one eye by means of which the spring element can be fastened to the brake caliper 13. Ideally, the protruding end of the spring element is completely fastened to the brake caliper 13, whereas the attachment at its other protruding end is embodied so that the leaf spring element in this case, despite being fastened to the brake caliper, is able to execute a movement in and counter to the direction of travel. This prevents a tensile force from being produced in the spring element when pressure is exerted on the brake shoe, which tensile force counterproductively acts in opposition to the actuating force exerted by the brake clamp. Preferably, such a "movable bearing" is embodied at the end that is on top during downward travel, which promotes the catching of the car that must be guaranteed in the event of an emergency, contrary to what is shown in this respect in FIG. 4, where the "movable bearing" is respectively provided at the bottom.

In this way, the spring element 14 is rigid enough in and counter to the direction of travel to transmit the braking forces produced by the brake shoes 11*a*, 11*b* fully to the brake caliper 13, which in turn transmits them to the car. At the same time, the spring element is flexible and elastic enough in the direction in which the brake shoes are pressed by the clamp jaws 8*a*, 8*b* (symbolized by the arrow F) to transmit the actuation forces exerted by the brake clamp fully to the respective brake shoe—small friction losses do occur, but are negligible in this case.

This kind of attachment of the brake shoes is advantageous in comparison to the support of the brake shoes in slide bearings, which is also possible in principle (as is known from vehicle disc brakes). This is because there are no friction losses even if over many years of operation, contamination occurs that would impair a slide bearing or if the system is operated in a corrosive environment, which can be the case, for example, in ship elevators.

It is essential that the braking forces that are produced during braking can be conveyed past the brake clamp, i.e. do not put any strain on the latter. As a result of this, the brake clamp can be embodied as significantly lighter in weight than a brake clamp, which must ensure a transmission of braking forces to the car. This opens up the possibility of using the entire brake device in such a way that it is accommodated along with the brake clamp in a space between two most often horizontally extending, adjacent car frame parts, as is explained in greater detail below.

It should also be noted that as a rule, the brake clamp remains in contact with the brake shoes or has only a small amount of play relative to them even when the brake is completely released. Since the brake clamp is intrinsically articulated, even when the brake is released, i.e. an actuator is active, the brake clamp does not require anything regarding the position of the clamp jaws. Instead, the brake shoes, which are pressed back into their inactive position by the leaf springs, require the so-called middle position of the brake clamp when the brake is released.

The Function of the Brake Clamp

The arrangement composed of the two lever arms 5*a* and 5*b* and the associated coupling element 6, as mentioned above, ends up comprising a four-bar linkage.

In general, this results in the fact that the entire brake clamp is able to move in the region of the clamp jaws 8*a*, 8*b*. In this way, whenever the guide rail 12 has a local position deviation along the braking path during braking, the brake clamp can—through the pivoting of both lever arms 5*a* and 5*b* in the same direction laterally to the direction of travel—follow the course of the guide rail, thus ensuring, even during braking procedures, that the brake clamp remains fully centered on the braking rail.

Figure 3:
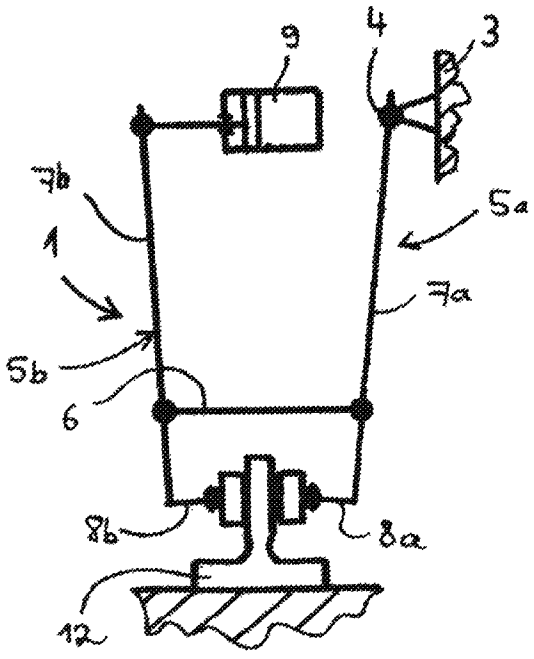
FIG. 3 schematically depicts how the brake clamp automatically centers itself relative to the guide rail after it is applied starting from the position shown in FIG. 2.

In a similar way, a centering of the brake clamp as needed is achieved when the brake reacts, as is shown in an exaggeratedly clear depiction in FIGS. 2 and 3:

As shown in FIG. 2, when the brake device reacts, it is possible that the guide rail used for braking may, due to tolerances, not be exactly centered between the brake shoes that are about to be placed against the guide rail. Then a situation shown in FIG. 3 occurs, in which first the brake shoe 11*b* comes into contact with the guide rail. Then in the course of the further movement of the actuating rod that is being actuated by the actuator and is extending transverse to the direction of travel, the lever arm 5*b* pivots outward about the point at which it rolls against the brake shoe. As a result of this, it pulls on the coupling element transverse to the direction of travel and moves it in translatory fashion, toward the left in the example shown. As a result, the lever arm 5*a* pivots about the pivot axle 4 in the direction toward the guide rail. Because of this, the brake shoe 11*a* allocated to this lever arm 5*a* also comes into contact with the guide rail. The brake clamp has now centered itself automatically relative to the guide rail and can then exert the normal forces that are required for the desired braking force on the brake shoes.

It should also be noted that the brake clamp according to the invention also offers the possibility of setting the—most well-centered possible—position, which it ought to assume when the brake is released.

To this end, the two centering spring elements 18 can be provided, which are preferably each actuated by means of a centering screw 19. Depending on the degree to which the left and right centering screw is tightened or loosened, it is possible to preset the precise position that the brake clamp assumes in the fully open state. Naturally, this predetermined position can also be preset merely by means of a single spring element or by means of a single spring element that can be adjusted with a centering screw 19. If a single spring element is provided, then this should nevertheless be able to transmit both tension and compression to the brake clamp.

Exemplary Embodiment with Several Brake Clamps

Figure 7:
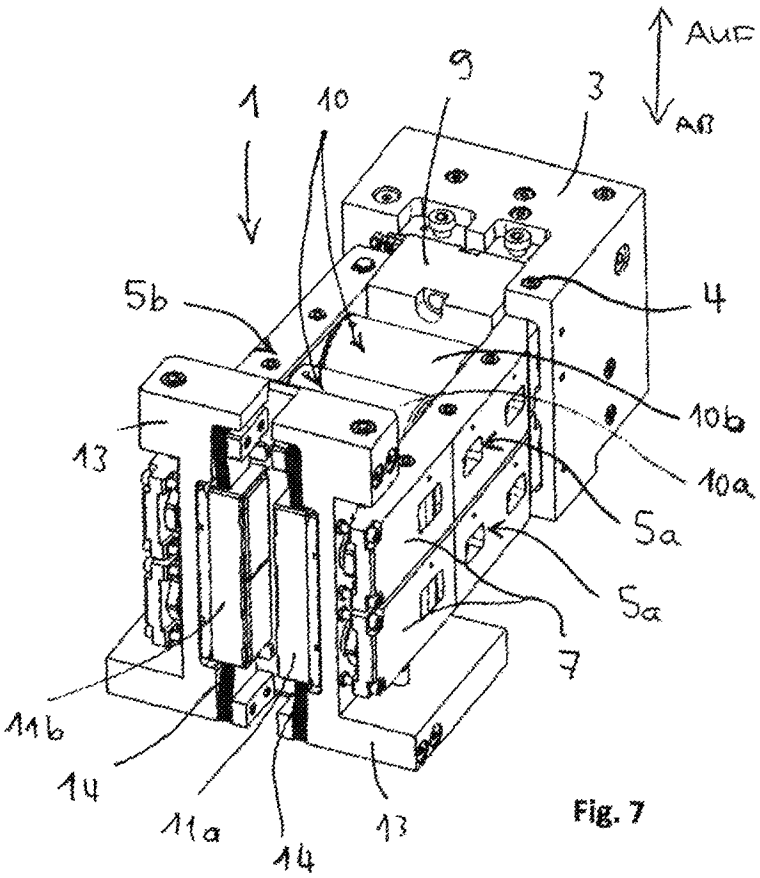
FIG. 7 shows the brake device according to FIG. 5 in the removed state, without the cover plate and without the base plate.
Figure 6:
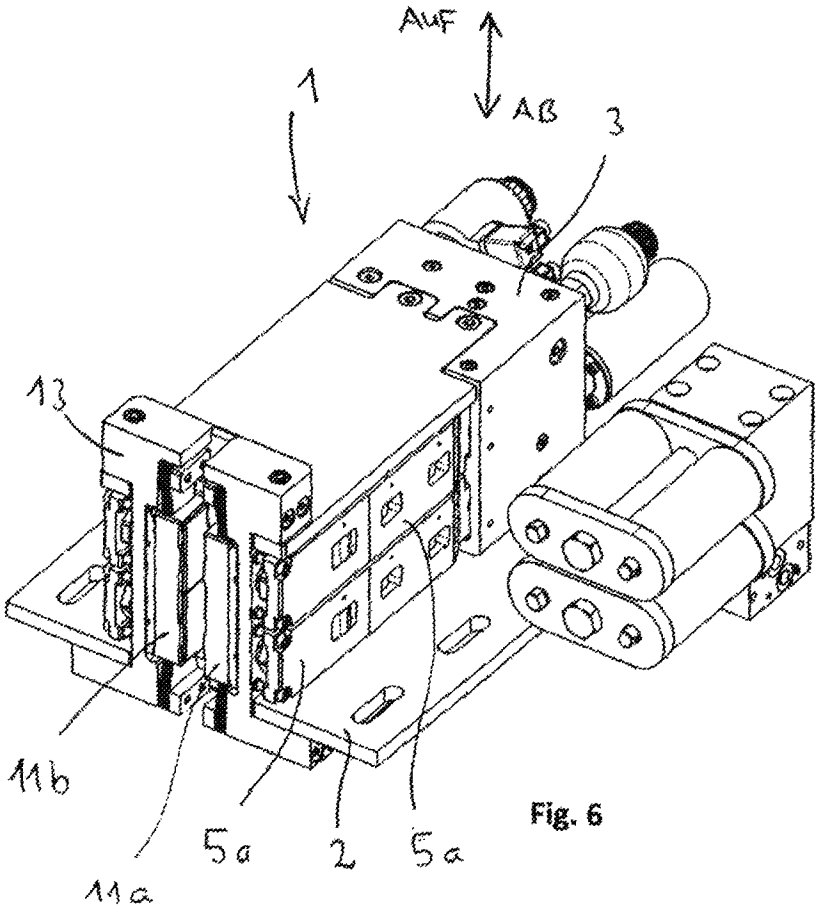
FIG. 6 is a perspective view, diagonally from above, of the brake device according to FIG. 5 in the removed state, with a closed upper cover plate and with the base plate for mounting to the car support.

FIGS. 6 and 7 give the best overview of the exemplary embodiment according to the invention.

The reference numeral 1 here indicates the brake device according to the invention as a whole.

In this case, the brake device 1 is mounted to a base plate 2 in FIG. 6. The base plate 2 serves to facilitate mounting the brake device 1 to the car frame 16, which will be explained in greater detail below. The base plate 2, however, is not obligatory. In this case, the base plate 2 supports a bearing pedestal 3, which is preferably screw-mounted to the base plate. The bearing pedestal 3 provides a pivot axle 4. The pivot axle 4 extends, as is clearly shown, entirely or at least essentially parallel to the direction of travel, which in this instance is symbolized by the UP/DOWN movement arrow. The pivot axle 4 serves to connect one of the clamp arms—which will be explained in greater detail below—of at least one brake clamp to the car in pivoting fashion. The pivot axle 4 is affixed relative to the car in stationary fashion, i.e. in the fully assembled state of all components, is not able to move relative to the car. In the case of an actuator that is hydraulically actuated, the bearing pedestal simultaneously serves to support the necessary components of the hydraulic system (one or more valves, possibly a pressure accumulator, etc.) and—most often by means of corresponding bores—to produce the necessary fluidic connection between the individual components of the hydraulic system and with the actuator.

In the present exemplary embodiment, not just a single brake clamp is provided, but instead, two brake clamps are installed, which are situated one after the other when viewed in the direction of travel. Each of the brake clamps is equipped with at least one main spring element 10, which is composed of one or more, preferably two, parallel-acting main springs 10*a*, 10*b*. Advantageously, each of the brake clamps is also equipped with its own actuator. The brake clamps can be secured to a shared pivot axle 4 or to a plurality of them arranged aligned with one after another in a line.

This yields a system, which makes it possible, by using interchangeable parts, to produce brake devices for different car loads.

Figure 5:
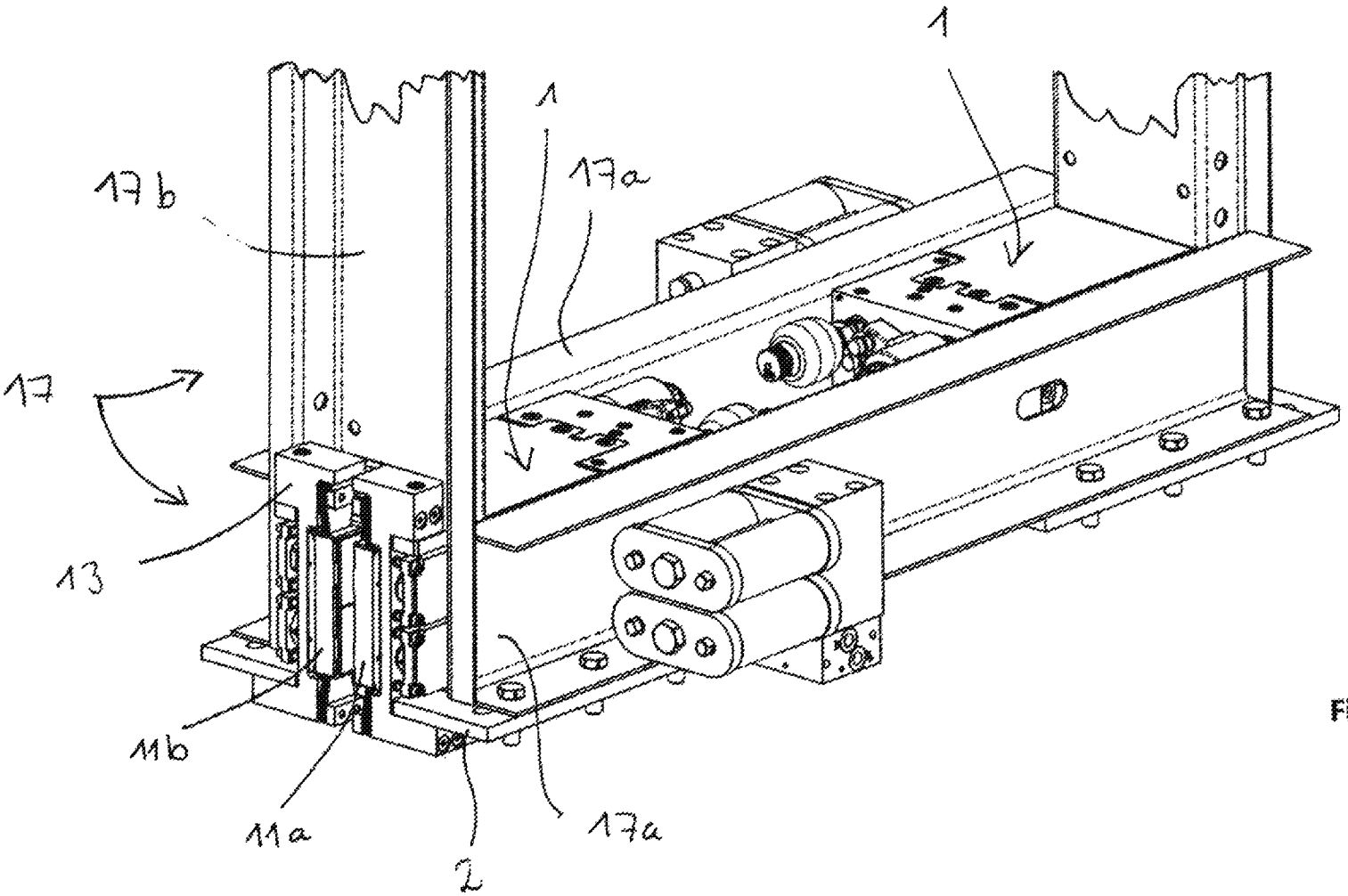
FIG. 5 shows a real exemplary embodiment of a brake device according to the invention, mounted on the car in the context of an elevator of the claimed type (detail).

For average car loads, for example, it is thus possible to construct a system that uses two brake clamps that work in parallel, each of which is embodied as has been explained in principle above. FIG. 5 through 7 show such a system. The drawings here clearly show the two pairs of lever arms 5*a*, 5*b* of the two brake clamps that can preferably be actuated independently of each other, whose corresponding lever arms 5*a*, 5*a* and 5*b*, 5*b* are preferably not connected to each other.

Also clearly visible is the brake caliper 13, which holds the brake shoes in this case each against a leaf spring element 14 in an elastically movable fashion, as outlined above in connection with FIG. 4. Hinted at in the drawings is the fact that each clamp arm 7*a*, 7*a*, 7*b*, 7*b* acts on the back side of the brake shoe 11*a*, 11*b* allocated to it by means of an adjusting screw (most often in the form of a threaded pin, which is screwed deeper or less deep into a threaded bore in the clamp jaw and then, by being locked by means of a nut, can be fixed in position in order to produce a play-free contact between the brake clamp and the brake shoe). For this purpose, the adjusting screws extend through openings in the brake caliper and thus reach the back side of the brake shoes 11*a*, 11*b*.

For small car loads, the system is embodied correspondingly, but only one brake clamp is used.

For larger car loads, three or more brake clamps are used—which are installed and function in a fashion analogous to the ones shown in FIG. 6.

FIG. 5 shows the preferred installation site of the brake device according to the invention on the car. In this case, the drawing clearly shows the two lower horizontal frame parts 17*a* of the car support ("sling") that extend parallel to and spaced apart from each other, which are fastened to two vertical frame parts 17*b* of the car frame 16 that likewise extend parallel to and spaced apart from each other. The very compact brake clamp makes it possible to install the brake device in the space between the two lower horizontal frame parts 17*a* so that the considerable span of the brake clamp in the horizontal direction does not play any role and in particular, does not restrict the amount of usable space for the elevator cabin. As is clearly visible, the base plate 2 is placed for this purpose against the horizontal frame parts and is fastened to them, preferably by means of screws.

Figure 8:
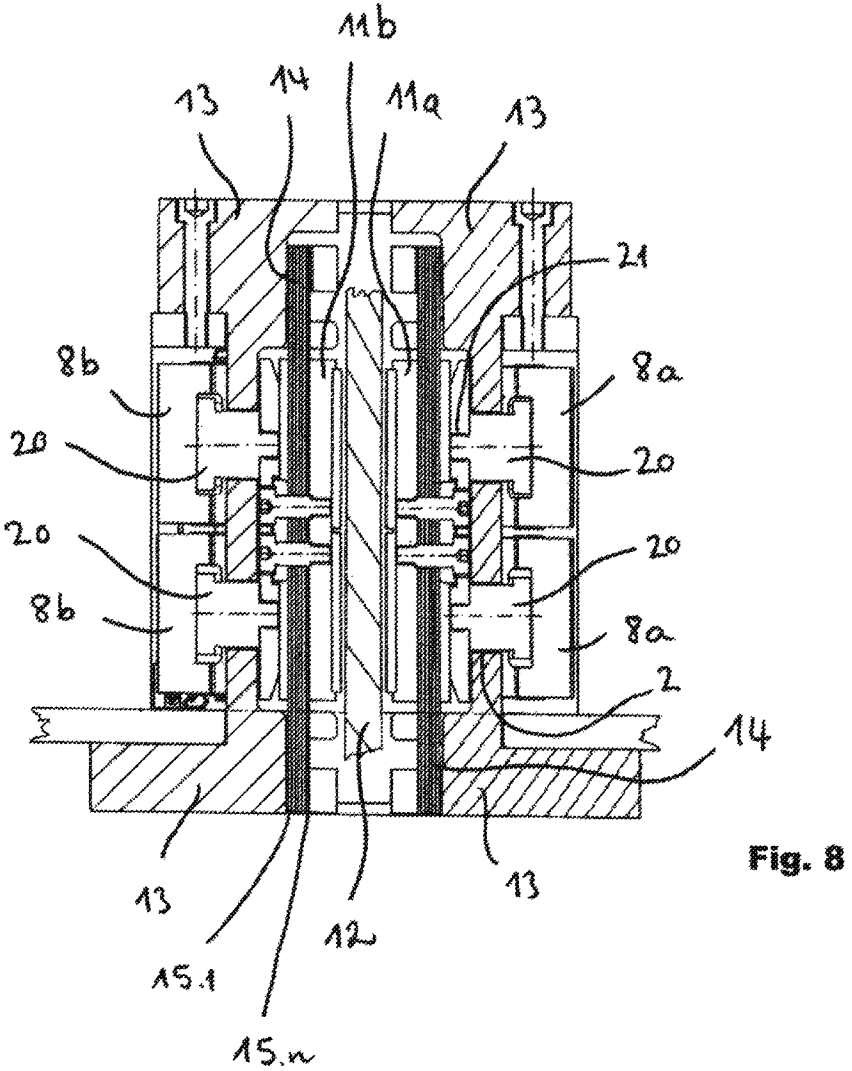
FIG. 8 shows a section through the brake caliper already shown in FIGS. 5, 6, and 7.

FIG. 8 shows a section through the brake caliper 13 used in this exemplary embodiment and the brake shoes mounted in it. That which has been stated above in connection with FIG. 4 applies here correspondingly, provided that nothing to the contrary is stated in the explanations below.

Here, too, the brake shoes 11*a*, 11*b* are secured to the brake caliper 13 in a way that allows them to move transversely, preferably by means of leaf spring elements 14 from a number of leaf spring leaves 15.1 through 15.*n*. As is clear from the drawing, in the vicinity of the middle of each brake shoe 11*a*, 11*b*, at least one holding screw is provided (in this case, two of them), which fasten(s) the respective brake lining 11*a*, 11*b* to the relevant leaf spring element 14 so that the brake shoe cannot move in and counter to the direction of travel on the leaf spring element 14. On the back side of each brake block oriented away from the braking or guide rail 12, a clamping pad 20 is mounted, preferably screw-mounted from the outside of the brake caliper. The clamping pad extends through a window 21 of the brake caliper 13 and protrudes on its outside oriented away from the brake lining so that the clamp jaw 8*a* or 8*b* allocated to it can act on it. Since the design to which FIG. 8 refers has two brake clamps that preferably operate independently of each other, according to FIG. 8, there are thus four clamping pads 20, each of which cooperates with a respective clamp arm 7*a*, 7*b*.

Each respective clamping pad 20 in this case is preferably not supported in the inner face of the window 21, not in the manner of a slide bearing. Instead, it extends through the inner face of the window, preferably in a contact-free manner. The clamping pad 20 is regularly only held in position by the fact that it is fastened to the brake shoe that is allocated to it and together with it, is held in a definite position by the spring element 14. The play between the inner face and the clamping pad is selected so that the clamping pad 20 does not tilt in the inner face even if only one of the two brake clamps closes for whatever reason and this results in a certain inclined position of the clamping pad.

The surface of the clamping pad 20 oriented away from the respective brake lining preferably rests against the clamp jaws 8*a*, 8*b* that are allocated to it so that this pressure and/or only normal forces can be transmitted to the clamping pad. As is clear from the drawings, the recesses provided in the clamp jaws for the clamping pads are generously dimensioned so that no transverse forces can be transmitted to the clamp jaws in and contrary to the direction of travel.

The invention claimed is:

1. An elevator with a brake device for braking a car, or for keeping the car stationary on at least one braking rail, or for both braking the car and keeping the car stationary on at least one braking rail, the brake device comprising:

at least two brake shoes situated opposite from each other; and at least one brake clamp with two clamp arms for opening and closing clamp jaws acting on the brake shoes, wherein only a first clamp arm of the at least one brake clamp is connected to the car in pivoting fashion via a bearing with a pivot axle that is affixed to the car, oriented parallel to a direction of travel, and a second clamp arm of the brake clamp is not affixed at any point relative to the car so that the second clamp arm is able to execute a movement relative to the car, even a movement with a translatory component.

2. The elevator according to claim 1, wherein the second clamp arm is connected to an actuator for actuating the brake clamp.

3. The elevator according to claim 2, wherein—in a region of the clamp arms that lies between the actuator and a coupling element—at least one spring element acts on the brake clamp, which is able to close the brake clamp completely.

4. The elevator according to claim 2, wherein the actuator is fastened to the car in such a way that the actuator is stationary relative to the car so that only the actuating element embodied as a rod, with which the actuator acts on the second clamp arm, is able to move relative to the car.

5. The elevator according to claim 1, wherein the brake clamp is supported on the car—or on a component affixed, to the car—in such a way that the clamp jaws, by pivoting together in the same direction, are able to follow a movement that is forced on one of the brake shoes due to local position deviations of the associated braking rail.

6. The elevator according to claim 5, wherein the brake clamp constitutes a four-bar linkage composed of two lever arms and one coupling element embodied in the form of a rod, in which the two lever arms are attached in pivoting fashion to different points on the coupling element.

7. The elevator according to claim 6, wherein sections of the lever arms that are situated on a side of the coupling element oriented away from the brake shoes constitute the clamp arms and sections of the lever arms that are situated on a side of the coupling element oriented toward the brake shoes constitute the clamp jaws.

8. The elevator according to claim 5, wherein each clamp jaw is coupled to the brake shoe(s) allocated to it in such a way that only normal forces can be transmitted between the clamp jaws and the brake shoe(s).

9. The elevator according to claim 1, comprising a brake caliper on which the brake shoes are supported in movable fashion and which transmits braking forces produced by the brake shoes during braking to the car; and wherein no forces that act parallel to the direction of travel (shear forces) are transmitted from the brake clamp to the brake shoes and from the brake shoes to the brake clamp.

10. The elevator according to claim 9, wherein the brake clamp constitutes a four-bar linkage composed of two lever arms and one coupling element embodied in the form of a rod, in which the two lever arms are attached in pivoting fashion to different points on the coupling element.

11. The elevator according to claim 10, wherein sections of the lever arms that are situated on a side of the coupling element oriented away from the brake shoes constitute the clamp arms and sections of the lever arms that are situated on a side of the coupling element oriented toward the brake shoes constitute the clamp jaws.

12. The elevator according to claim 9, wherein each clamp jaw is coupled to the brake shoe(s) allocated to it in such a way that only normal forces can be transmitted between the clamp jaws and the brake shoe(s).

13. The elevator according to claim 1, wherein the brake clamp constitutes a four-bar linkage composed of two lever arms and one coupling element embodied in the form of a rod, in which the two lever arms are attached in pivoting fashion to different points on the coupling element.

14. The elevator according to claim 13, wherein sections of the lever arms that are situated on a side of the coupling element oriented away from the brake shoes constitute the clamp arms and sections of the lever arms that are situated on a side of the coupling element oriented toward the brake shoes constitute the clamp jaws.

15. The elevator according to claim 1, wherein each clamp jaw is coupled to the brake shoe(s) allocated to it in such a way that only normal forces can be transmitted between the clamp jaws and the brake shoe(s).

* * * * *